US011122959B2

(12) United States Patent
Kopera et al.

(10) Patent No.: US 11,122,959 B2
(45) Date of Patent: Sep. 21, 2021

(54) DISHWASHING APPLIANCE HAVING AN AIR-DRYING DEHUMIDIFICATION ASSEMBLY

(71) Applicant: Haier US Appliance Solutions, Inc., Wilmington, DE (US)

(72) Inventors: Timothy Kopera, Louisville, KY (US); Adam Christopher Hofmann, Louisville, KY (US); Ramasamy Thiyagarajan, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 43 days.

(21) Appl. No.: 16/748,902

(22) Filed: Jan. 22, 2020

(65) Prior Publication Data

US 2021/0219814 A1 Jul. 22, 2021

(51) Int. Cl.

| | |
|---|---|
| ***A47L 15/48*** | (2006.01) |
| ***A47L 15/22*** | (2006.01) |
| ***A47L 15/42*** | (2006.01) |
| ***A47L 15/00*** | (2006.01) |

(52) U.S. Cl.

CPC ..... *A47L 15/48* (2013.01); *A47L 15/0013* (2013.01); *A47L 15/22* (2013.01); *A47L 15/4225* (2013.01); *A47L 15/4257* (2013.01); *A47L 15/4285* (2013.01); *A47L 2601/02* (2013.01)

(58) Field of Classification Search

CPC ..... A47L 15/48; A47L 15/0013; A47L 15/22; A47L 15/4225; A47L 15/4257; A47L 15/4285; A47L 2601/02

See application file for complete search history.

(56) References Cited

U.S. PATENT DOCUMENTS 1,836,373 A * 12/1931 Kadesch ..... A47L 15/00 134/56 D
3,598,131 A * 8/1971 Weihe, Jr. ..... B08B 15/00 134/107

(Continued)

FOREIGN PATENT DOCUMENTS

CN 107149452 A 9/2017

OTHER PUBLICATIONS

Bengtsson et al., Concept study of a new method for drying dishware in a heat pump dishwasher, Energy Efficiency, Jul. 10, 2017, 10 pages.

*Primary Examiner* — Benjamin L Osterhout
(74) *Attorney, Agent, or Firm* — Dority & Manning, P.A.

(57) ABSTRACT

A dishwashing appliance, as provided herein, may include a cabinet, a tub, a pump, a spray assembly, a fluid recirculation duct, and a cold water line. The tub may be housed within the cabinet and define a wash chamber. The fluid recirculation duct may extend from a path inlet to a path outlet to recirculate air within the wash chamber. The path inlet may be defined in fluid communication between the wash chamber and the path outlet. The path outlet may be defined in fluid communication between the path inlet and the wash chamber downstream from the path inlet. The cold water line may extend through the fluid recirculation duct. The cold water line may define a cold water nozzle that is disposed within the fluid recirculation duct to provide a condensing, cold-water flow into the fluid recirculation duct between the path inlet and the path outlet.

18 Claims, 6 Drawing Sheets

(56) References Cited

U.S. PATENT DOCUMENTS

| | | | | |
|---|---|---|---|---|
| 6,170,166 | B1 * | 1/2001 | Johansen | A47L 15/48 34/595 |
| 7,604,014 | B2 | 10/2009 | Paintner | |
| 8,307,839 | B2 * | 11/2012 | Peukert | A47L 15/241 134/107 |
| 8,869,424 | B2 * | 10/2014 | Hermann | A47L 15/0034 34/486 |
| 9,949,611 | B1 | 4/2018 | Gluesenkamp | |
| 10,750,925 | B2 * | 8/2020 | Vallejo | A47L 15/483 |
| 2004/0261820 | A1 * | 12/2004 | Monsrud | A47L 15/483 134/10 |
| 2007/0157954 | A1 * | 7/2007 | Classen | A47L 15/481 134/56 D |
| 2008/0149142 | A1 * | 6/2008 | Jerg | A47L 15/481 134/25.2 |
| 2008/0264455 | A1 * | 10/2008 | Brewer | A47L 15/488 134/95.2 |
| 2008/0264458 | A1 * | 10/2008 | Berner | A47L 15/488 134/57 D |
| 2009/0038661 | A1 * | 2/2009 | Hildenbrand | A47L 15/483 134/56 D |
| 2010/0294323 | A1 * | 11/2010 | Brunswick | A47L 15/4291 134/56 D |
| 2010/0300499 | A1 | 12/2010 | Han et al. | |
| 2011/0114137 | A1 * | 5/2011 | Jerg | A47L 15/481 134/115 R |
| 2011/0120510 | A1 * | 5/2011 | Delle | A47L 15/481 134/115 R |
| 2011/0177772 | A1 * | 7/2011 | Hockaday | A47L 15/0081 454/341 |
| 2013/0152968 | A1 * | 6/2013 | Bertsch | A47L 15/0013 134/18 |

* cited by examiner

DISHWASHING APPLIANCE HAVING AN AIR-DRYING DEHUMIDIFICATION ASSEMBLY

FIELD OF THE INVENTION

The present subject matter relates generally to washer appliances, and more particularly to dishwashing appliances having an assembly for circulating drying air therein.

BACKGROUND OF THE INVENTION

Dishwashing appliances generally include a tub that defines a wash chamber for receipt of articles for washing. Certain dishwasher assemblies also include a rack assembly slidably mounted within the wash chamber. A user can load articles, such as plates, bowls, glasses, or cups, into the rack assembly, and the rack assembly can support such articles within the wash chamber during operation of the dishwashing appliance. Spray assemblies within the wash chamber can apply or direct wash fluid towards articles disposed within the rack assemblies in order to clean such articles. Multiple spray assemblies can be provided, including, for example, a lower spray arm assembly mounted to the tub at a bottom of the wash chamber; a mid-level spray arm assembly mounted to one of the rack assemblies; or an upper spray assembly mounted to the tub at a top of the wash chamber. Other configurations may be used as well.

After the spray assemblies have washed or sprayed articles on the rack assemblies, typical dishwashing appliances provide one or more features to circulate air and remove moisture from (i.e., dry) the articles. Commonly, such features are provided as part of a closed loop or an open loop system. Closed loop systems often draw air from the wash chamber through a small inlet in one corner of the door before returning that same air to the wash chamber (e.g., after being heated or dried). Open loop systems generally motivate air from the ambient environment to the wash chamber, such as through a small vent within the door.

These existing systems present a number of drawbacks. For instance, existing appliances often have difficulty managing the moisture or humidity within the air being circulated. In existing appliances with a closed loop system, an appliance may have difficulty removing moisture from air or may have a limited absorption capacity. In existing appliances with an open loop system, performance may be uneven or undesirably influenced by humidity in the ambient air. Moreover, any energy used to heat air within the wash chamber is generally lost to the ambient environment.

There is, thus, a need for an improved dishwashing appliance. In particular, it would be advantageous to provide a dishwashing appliance with one or more features to efficiently dry air within the wash chamber.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a dishwashing appliance is provided. The dishwashing appliance may include a cabinet, a tub, a pump, a spray assembly, a fluid recirculation duct, and a cold water line. The tub may be housed within the cabinet and may define a wash chamber. The pump may be configured to deliver a wash fluid to the wash chamber. The spray assembly may be housed within the wash chamber of the tub in fluid communication with the pump to receive wash fluid therefrom. The fluid recirculation duct may extend from a path inlet to a path outlet to recirculate air within the wash chamber. The path inlet may be defined in fluid communication between the wash chamber and the path outlet. The path outlet may be defined in fluid communication between the path inlet and the wash chamber downstream from the path inlet. The cold water line may extend through the fluid recirculation duct. The cold water line may define a cold water nozzle that is disposed within the fluid recirculation duct to provide a condensing, cold-water flow into the fluid recirculation duct between the path inlet and the path outlet.

In another exemplary aspect of the present disclosure, a dishwashing appliance is provided. The dishwashing appliance may include a cabinet, a tub, a pump, a spray assembly, a fluid recirculation duct, and a cold water line. The tub may be housed within the cabinet and may define a wash chamber. The pump may be configured to deliver a wash fluid to the wash chamber. The spray assembly may be housed within the wash chamber of the tub in fluid communication with the pump to receive wash fluid therefrom. The fluid recirculation duct may extend from a path inlet to a path outlet to recirculate air within the wash chamber. The path inlet may be defined in fluid communication between the wash chamber and the path outlet. The path outlet may be defined in fluid communication between the path inlet and the wash chamber downstream from the path inlet. The fluid recirculation duct may further define a collection outlet upstream from the path outlet to permit condensed water to flow from the fluid recirculation duct. The cold water line may extend through the fluid recirculation duct. The cold water line may define a cold water nozzle that is disposed within the fluid recirculation duct upstream from the collection outlet to provide a condensing, cold-water flow into the fluid recirculation duct between the path inlet and the path outlet.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
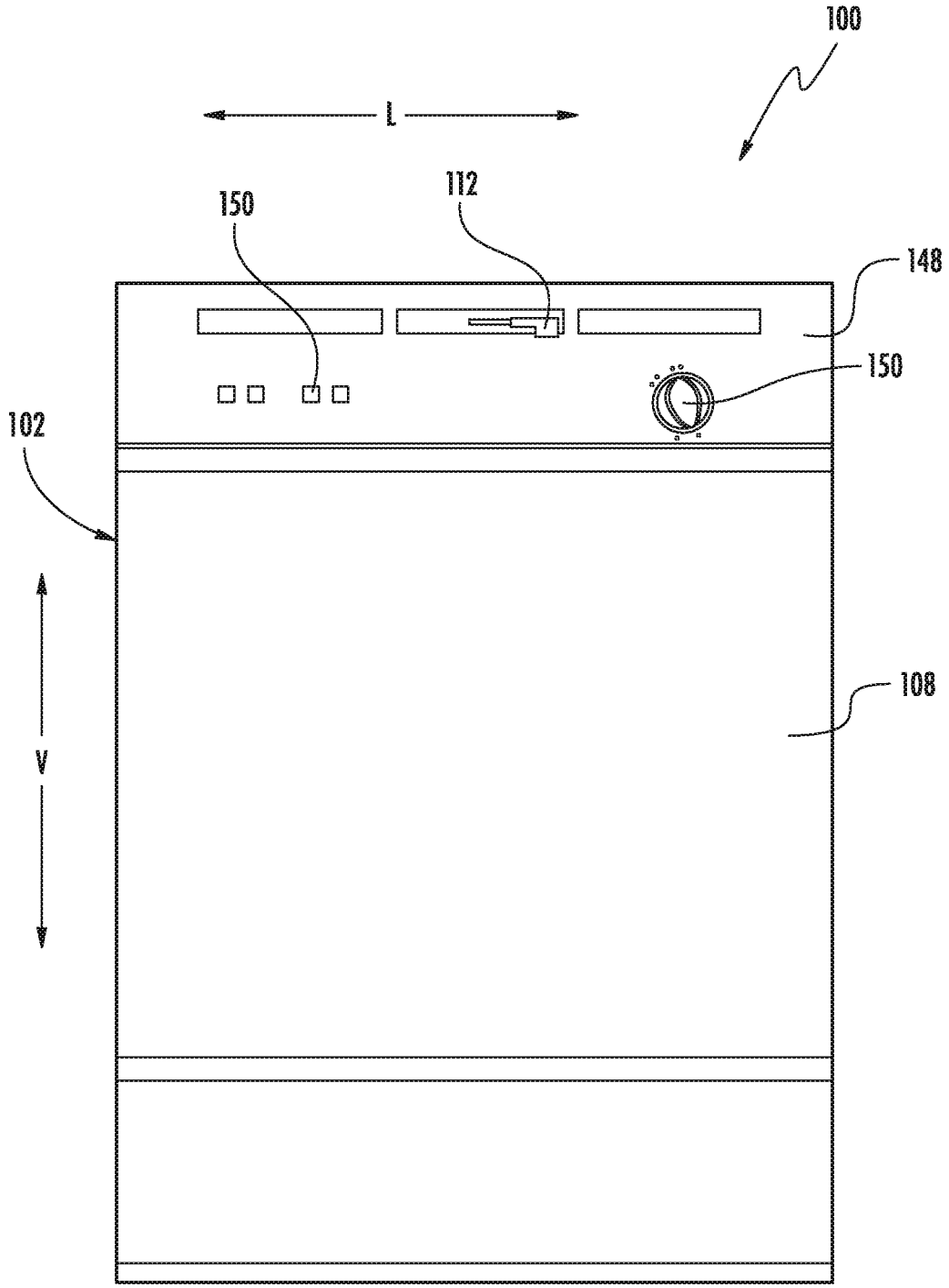
FIG. 1 provides a front elevation view of a dishwashing appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one element from another and are not intended to signify location or importance of the individual elements. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Figure 2:
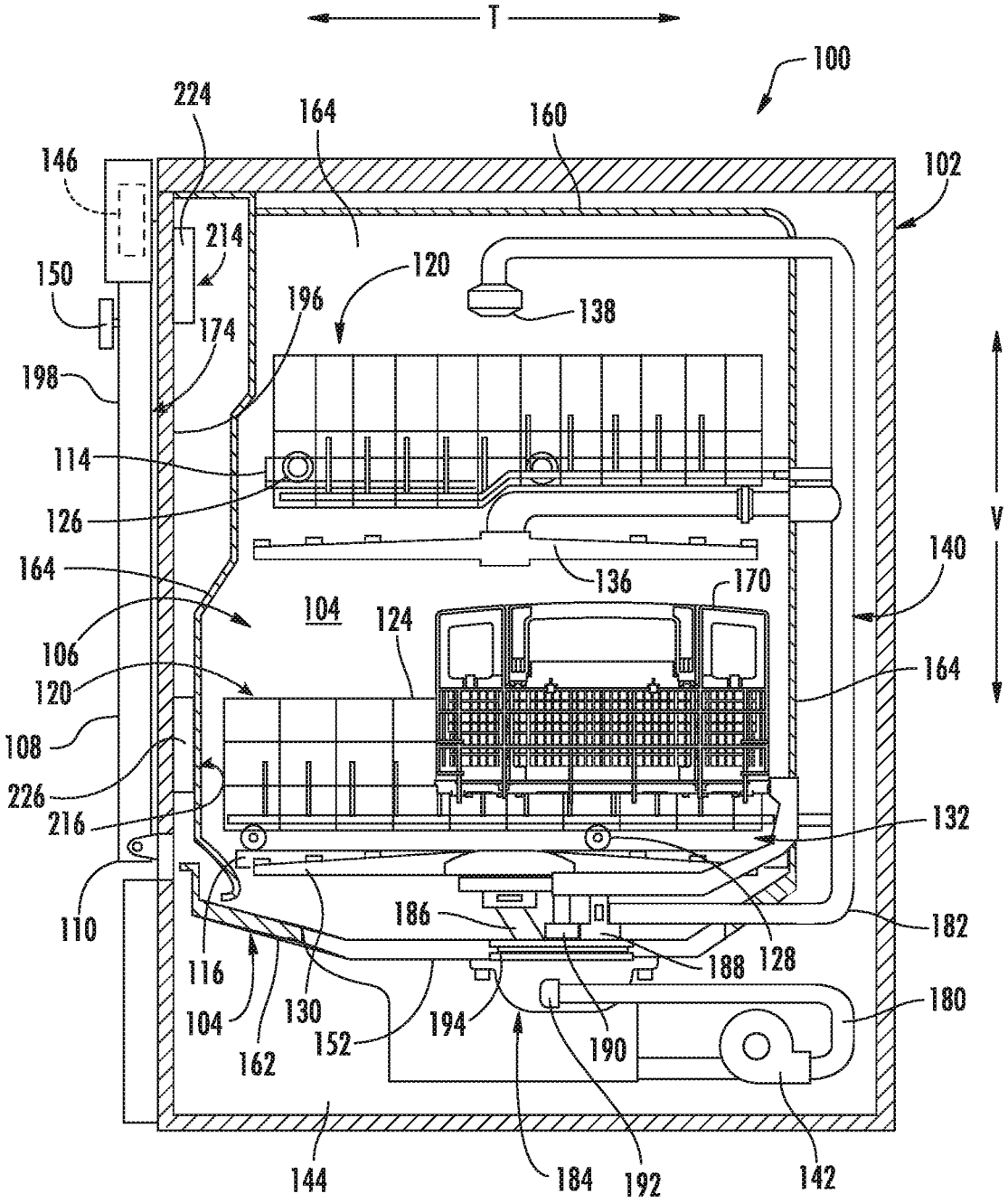
FIG. 2 provides a side, sectional view of the exemplary dishwashing appliance of FIG. 1.

Turning now to the figures, FIGS. 1 and 2 illustrate a domestic dishwashing appliance 100 according to exemplary embodiments of the present disclosure. As shown in FIGS. 1 and 2, the dishwashing appliance 100 may include a cabinet 102 having a tub 104 therein defining a wash chamber 106. The tub 104 may generally include a front opening and a door 108 hinged at its bottom 110 for rotatable movement between a closed or vertical position (shown in FIGS. 1 and 2), wherein wash chamber 106 is sealed shut for washing operation and access to wash chamber 106 is restricted, and a horizontal open position for loading and unloading of articles from the dishwashing appliance 100. As shown in FIG. 1, a latch 112 may be used to lock and unlock the door 108 for access to the chamber 106.

Generally, cabinet 102 may define a discrete vertical direction V, lateral direction L, and transverse direction T. Vertical direction V, lateral direction L, and transverse direction T are mutually perpendicular such that vertical direction V, lateral direction L, and transverse direction T form an orthogonal directional system.

As is understood, the tub 104 may generally have a rectangular cross-section defined by various wall panels or walls. For example, as shown in FIG. 2, the tub 104 may include a top wall 160 and a bottom wall 162 spaced apart from one another along a vertical direction V of the dishwashing appliance 100. Additionally, the tub 104 may include a plurality of sidewalls 164 (e.g., three sidewalls) extending between the top and bottom walls 160, 162. It should be appreciated that the tub 104 may generally be formed from any suitable material. However, in optional embodiments, the tub 104 may be formed from a ferritic material, such as stainless steel, or a polymeric material.

As particularly shown in FIG. 2, upper and lower guide rails 114, 116 may be mounted on opposing sidewalls 164 of the tub 104 and may be configured to accommodate roller-equipped rack assemblies 120 and 122. Each of the rack assemblies 120, 122 may be fabricated into lattice structures including a plurality of elongated members 124 (for clarity of illustration, not all elongated members making up assemblies 120 and 122 are shown in FIG. 2). Additionally, each rack 120, 122 may be adapted for movement between an extended loading position (not shown) in which the rack 120, 122 is substantially positioned outside wash chamber 106, and a retracted position (shown in FIGS. 1 and 2) in which the rack 120, 122 is located inside wash chamber 106. This may be facilitated by rollers 126 and 128, for example, mounted onto racks 120 and 122, respectively.

In some embodiments, a silverware basket 170 is removably mounted to lower rack assembly 122. However, in alternative exemplary embodiments, the silverware basket 170 may also be selectively attached to other portions of dishwashing appliance 100 (e.g., door 108). The silverware basket 170 defines one or more storage chambers and is generally configured to receive of silverware, flatware, utensils, and the like, that are too small to be accommodated by the upper and lower rack assemblies 120, 122. The silverware basket 170 may be constructed of any suitable material (e.g., metal or plastic) and define a plurality of fluid slots for permitting wash fluid therethrough.

The dishwashing appliance 100 includes one or more spray assemblies housed within wash chamber 106. For instance, the dishwashing appliance 100 may include a lower spray-arm assembly 130 that is rotatably mounted within a lower region 132 of wash chamber 106 directly above the bottom wall 162 of the tub 104 so as to rotate in relatively close proximity to the rack assembly 122. As shown in FIG. 2, a mid-level spray-arm assembly 136 may be located in an upper region of wash chamber 106, such as by being located in close proximity to the upper rack 120. Moreover, an upper spray assembly 138 may be located above the upper rack 120.

As is generally understood, the lower and mid-level spray-arm assemblies 130, 136 and the upper spray assembly 138 may generally form part of a fluid circulation assembly 140 for circulating fluid (e.g., water and dishwasher fluid) within the tub 104. As shown in FIG. 2, the fluid circulation assembly 140 may also include a pump 142 located in a machinery compartment 144 located below the bottom wall 162 of the tub 104. One or all of the spray assemblies 130, 136, 138 may be in fluid communication with the pump 142 (e.g., to receive a pressurized wash fluid therefrom). Additionally, each spray-arm assembly 130, 136 may include an arrangement of discharge ports or orifices for directing washing liquid onto dishes or other articles located in rack assemblies 120 and 122, which may provide a rotational force by virtue of washing fluid flowing through the discharge ports. The resultant rotation of the lower spray-arm assembly 130 provides coverage of dishes and other dishwasher contents with a spray (e.g., a spray of washing fluid).

It should be appreciated that, although the dishwashing appliance 100 will generally be described herein as including three spray assemblies 130, 136, 138, the dishwashing appliance may, in alternative embodiments, include any other number of spray assemblies, including two spray assemblies, four spray assemblies or five or more spray assemblies. For instance, in addition to the lower and mid-level spray-arm assemblies 130, 136 and the upper spray assembly 138 (or as an alternative thereto), the dishwashing appliance 100 may include one or more other spray assemblies or wash zones for distributing fluid within wash chamber 106.

The dishwashing appliance 100 may be further equipped with a controller 146 configured to regulate operation of the dishwasher 100. The controller 146 may generally include one or more memory devices and one or more microprocessors, such as one or more general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

The controller 146 may be positioned in a variety of locations throughout dishwashing appliance 100. In the illustrated embodiment, the controller 146 is located within a control panel area 148 of the door 108, as shown in FIG. 1. In some such embodiments, input/output ("I/O") signals are routed between the control system and various operational components of dishwashing appliance 100 along wiring harnesses that may be routed through the bottom 110 of the door 108. Typically, the controller 146 includes a user interface panel/controls 150 through which a user may select various operational features and modes and monitor progress of the dishwasher 100. In one embodiment, the user interface 150 may represent a general purpose I/O ("GPIO") device or functional block. Additionally, the user interface 150 may include input components, such as one or more of a variety of electrical, mechanical or electro-mechanical input devices including rotary dials, push buttons, and touch pads. The user interface 150 may also include a display component, such as a digital or analog display device designed to provide operational feedback to a user. The user interface 150 may be in communication with the controller 146 via one or more signal lines or shared communication busses.

Additionally or alternatively, as shown in FIG. 2, a portion of the bottom wall 162 of the tub 104 may be configured as a tub sump portion 152 that is configured to accommodate one or more components of the fluid recirculation assembly 140 (e.g., a filter assembly or other components). It should be appreciated that, in several embodiments, the bottom wall 162 of the tub 104 may be formed as a single, unitary component such that the tub sump portion 152 as well as the surrounding portions of the bottom wall 162 are formed integrally with one another. Alternatively, the tub sump portion 152 may be configured as a separate component configured to be attached to the remaining portion(s) of the bottom wall 162.

Optionally, as shown in FIG. 2, the fluid recirculation assembly 140 may also include a diverter assembly 184 in fluid communication with the pump 142 for diverting fluid between one or more of the spray-arm assemblies 130, 136, 138. For example, the diverter assembly 184 may, in several embodiments, include an inlet 192 coupled to the pump 142 (e.g., via pump conduit 180 shown in FIG. 2) for directing fluid into the diverter assembly 184 and first and second outlets 186, 188 for directing the fluid received from the pump 142 to the lower spray-arm assembly 130 or the mid-level and upper spray-arm assemblies 136, 138, respectively. In some such embodiments, the first outlet 186 may be configured to be directly coupled to the lower spray-arm assembly 130 and the second outlet 188 may be coupled to a suitable fluid conduit 182 of the fluid recirculation assembly 140 for directing fluid to the mid-level and upper spray-arm assemblies 136, 138. Additionally, the diverter assembly 184 may also include a diverter valve 194 to selectively divert the flow of fluid through the assembly 184 to the first outlet 186, the second outlet 188, or the third outlet 190.

It should be appreciated that the present subject matter is not limited to any particular style, model, or configuration of dishwashing appliance. The exemplary embodiments depicted in FIGS. 1 and 2 are simply provided for illustrative purposes only. For example, different locations may be provided for the user interface 150, different configurations may be provided for the racks 120, 122, and other differences may be applied as well.

Figure 3:
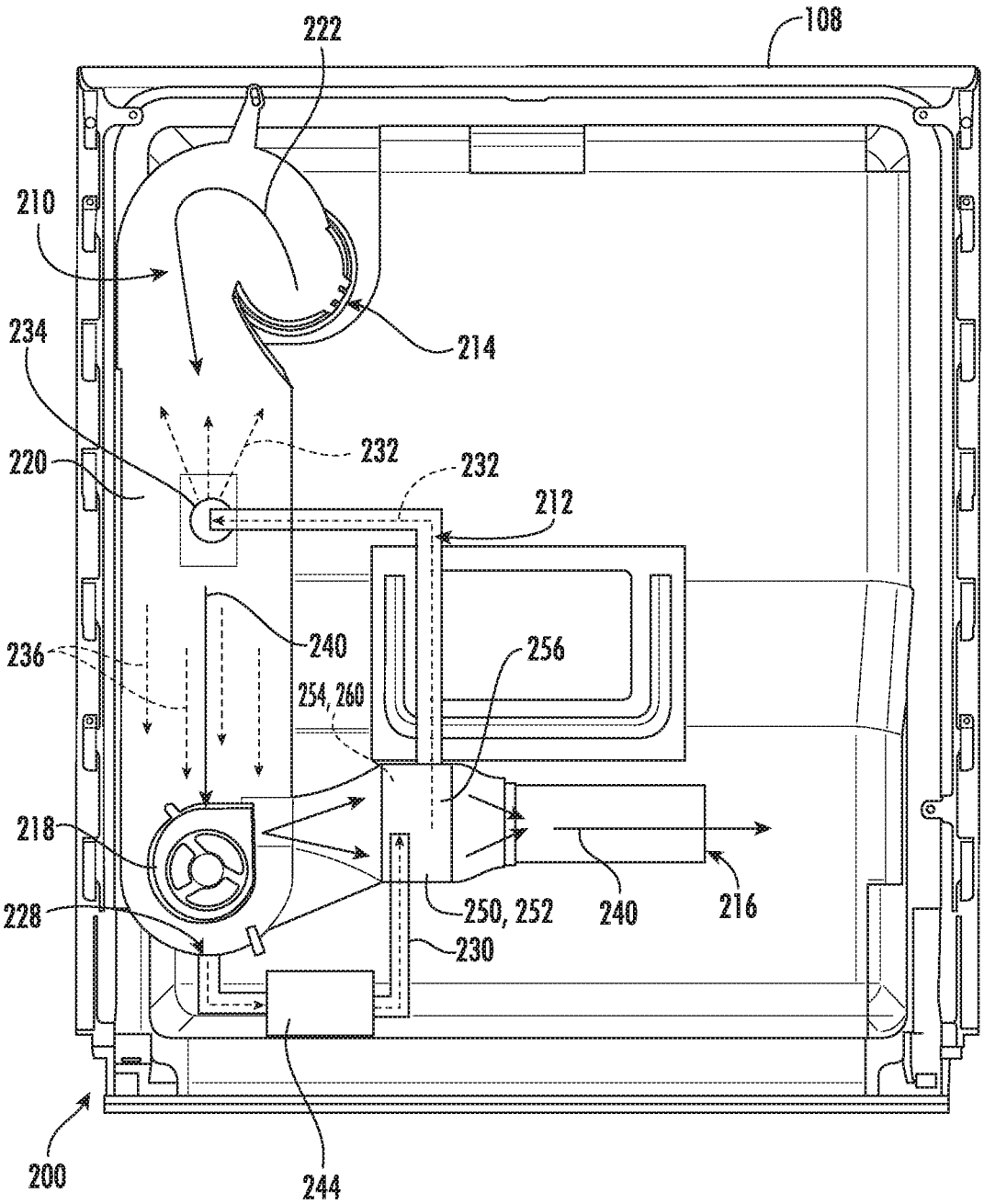
FIG. 3 provides a perspective view of an interior portion of the door of a dishwashing appliance according to exemplary embodiments of the present disclosure.
Figure 4:
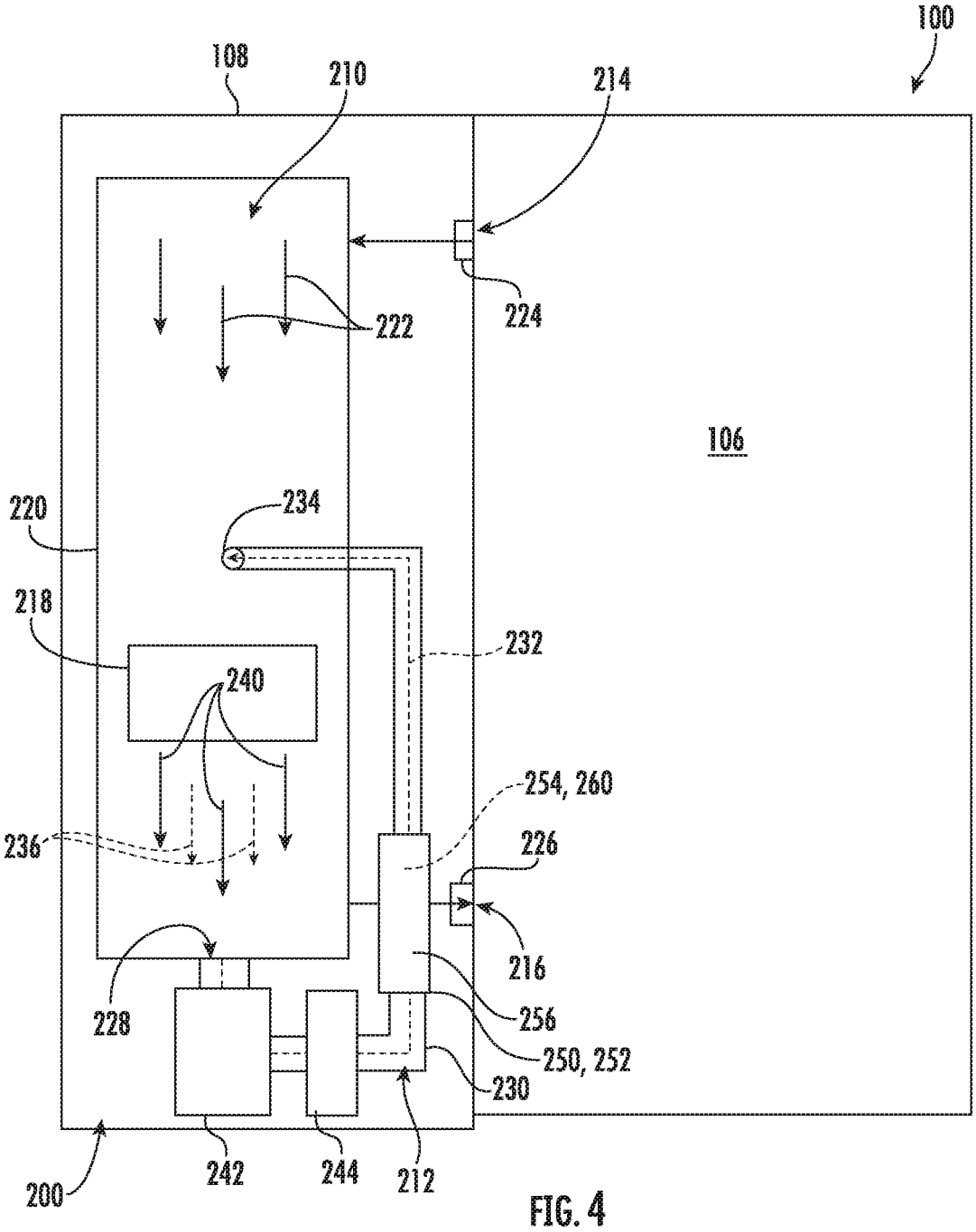
FIG. 4 provides a schematic view of a dishwashing appliance according to exemplary embodiments of the present disclosure.

Turning now to FIGS. 2 through 4, various views are provided that illustrate a dehumidification assembly 200 included with dishwashing appliance 100 according to exemplary embodiments of the present disclosure. Specifically, FIG. 3 provides a perspective view of an interior portion of the door 108 (e.g., between an inner panel 196 facing wash chamber 106 and an outer panel 198 facing the ambient environment) of dishwashing appliance 100. FIG. 4 provides a schematic view of dehumidification assembly 200 in relation to wash chamber 106 (e.g., when door 108 is in the closed position).

As shown, multiple discrete fluid paths 210, 212 are provided to selectively circulate air or vapor through dishwashing appliance 100 (e.g., as part of a drying or dry cycle). In particular, a discrete air path 210 and water path 212 may be provided. As will be described in greater detail below, during use, air path 210 (e.g., defined by fluid recirculation duct 220) may generally permit the recirculation of air through wash chamber 106 while water path 212 (e.g., defined by cold water line 230) permits the addition of a condensing, cold-water flow 232 to air path 210 (e.g., to a circulating airflow 222). During use, the condensing, cold-water flow 232 may advantageously prompt vaporized moisture within air path 210 (e.g., from wash chamber 106) to rapidly condense and separate from air before such air is returned to wash chamber 106.

A fluid recirculation duct 220 may define air path 210. For instance, fluid recirculation duct 220 extends from a path inlet 214 to a path outlet 216. Path inlet 214 may be defined (e.g., at an intake port 224) in fluid communication between wash chamber 106 and path outlet 216. Path outlet 216 may be defined (e.g., at an output port 226) downstream from path inlet 214 in fluid communication between path inlet 214 and wash chamber 106. For instance, path outlet 216 may be defined below path inlet 214. During use, air or vapor may exit wash chamber 106 and enter air path 210 through path inlet 214 (e.g., defined on or within door 108). From path inlet 214, at least a portion of the received air or vapor may flow through air path 210 before returning to wash chamber 106 through path outlet 216. Optionally, path outlet 216 may be aligned (e.g., vertically) with lower rack 122. Thus, path outlet 216 may be directed toward and at the same height as lower rack 122. Air returning to wash chamber 106 may advantageously flow to articles held on or within lower rack.

Along air path 210 (e.g., within fluid recirculation duct 220) a fan or blower 218 may be provided to motivate air or vapor from path inlet 214 to path outlet 216. Generally, fan 218 may include or be provided as any suitable air handler, such as an axial fan, tangential fan, etc. When assembled, fan 218 may be positioned between the path inlet 214 and path outlet 216 (i.e., downstream from path inlet 214 and upstream from path outlet 216). Moreover, fan 218 may be in operative (e.g., electrical or wireless) communication with controller 146. Controller 146 may thus selectively direct fan 218 to rotate or otherwise motivate air through air path 210.

In certain embodiments, fluid recirculation conduit defines a collection outlet 228 through which liquid (e.g., condensed water) may flow from water path 212. When assembled, collection outlet 228 may be downstream from path inlet 214 and upstream from path outlet 216. For instance, collection outlet 228 may be defined at a bottom end of fluid recirculation duct 220. As the water vapor within water path 212 condenses, the condensed water may collect (e.g., as motivated by gravity or fan 218) and flow from water path 212 through collection outlet 228 (e.g., to water path 212) without passing through path outlet 216.

Water path 212 may be defined, at least in part, by a cold water line 230 (e.g., formed from one or more conduits or pipes through which liquid water may flow). As shown, a portion of water path 212 terminates at a portion of air path 210. For instance, cold water line 230 may extend from an area outside of fluid recirculation duct 220 to the interior of fluid recirculation duct 220, which defines air path 210. Thus, cold water line 230 may extend through fluid recirculation duct 220 (e.g., a wall thereof). Within fluid recirculation duct 220, a cold water nozzle 234 defined by cold water line 230 may be disposed. Thus, cold water nozzle 234 may be disposed in fluid communication between path inlet 214 and path outlet 216 to provide a condensing, cold-water flow 232 into fluid recirculation duct 220 or air path 210.

Generally, cold water nozzle 234 defines one or more spray outlets from which a condensing, cold-water flow 232 may be directed (e.g., from cold water line 230 to the air path 210). Any suitable shape or configuration of nozzle may be provided at cold water nozzle 234. During use, as the condensing, cold-water flow 232 sprays within air path 210, the water thereof may mix or entrain with the air from the wash chamber 106, including vaporized moisture in the air. As the condensing, cold-water flow 232 mixes with the air from wash chamber 106, the vaporized moisture within air path 210 may condense and separate upstream from collection outlet 228 or path outlet 216. In turn, a separate liquid water stream 236 (e.g., of the mixture of condensing, cold-water flow 232 and the condensed moisture from wash chamber 106) and a separated air stream 240 (e.g., of the remaining air from wash chamber 106) may be formed within fluid recirculation duct 220. In optional embodiments, cold water nozzle 234 is positioned above collection outlet 228 or path outlet 216. The liquid water stream 236 may thus flow downward (e.g., as motivated by gravity) before reaching collection outlet 228 or path outlet 216.

In some embodiments, water path 212 is defined on a loop with a portion of air path 210 (e.g., within door 108). For instance, cold water line 230 and water path 212 may extend from collection outlet 228 to cold water nozzle 234 within fluid recirculation duct 220. In optional embodiments, an enlarged volume or reservoir 242 is defined along cold water line 230 to permit water to accumulate from the liquid water stream 236 outside of fluid recirculation duct 220. Reservoir 242 may be positioned below collection outlet 228, as shown. Thus, water may flow from the liquid water stream 236, through the collection outlet 228 and to reservoir 242 (e.g., upstream from cold water nozzle 234 within cold water line 230).

In additional or alternative embodiments, a water pump 244 is mounted along cold water line 230 to motivate water (e.g., condensed water) through cold water line 230 or water path 212. In particular, water may be motivated to the cold water nozzle 234. As would be understood, water pump 244 may be provided as any suitable pump (e.g., impeller pump, peristaltic pump, etc.) mounted within door 108 or otherwise on dishwasher appliance 100. When assembled, water pump 244 may be positioned between collection outlet 228 and cold water nozzle 234 (i.e., downstream from collection outlet 228 and upstream from cold water nozzle 234). Optionally, water pump 244 may further be positioned downstream from reservoir 242. Moreover, water pump 244 may be in operative (e.g., electrical or wireless) communication with controller 146. Controller 146 may thus selectively direct water pump 244 to rotate or otherwise motivate water through water path 212.

In further additional or alternative embodiments, an active chiller 250 is mounted along cold water line 230 to selectively draw heat from water within water path 212. Advantageously, the water of the condensing, cold-water flow 232 may thus be provided at a significantly lower temperature than the air of the circulating airflow 222, prompting rapid condensation and separation of vaporized moisture (e.g., within a relatively compact area or volume).

In some such embodiments, active chiller 250 includes, or is provided as, a thermoelectric heat exchanger (TEHE) 252 in thermal communication with cold water line 230 (e.g., water path 212). Generally, TEHE 252 may be any suitable solid state, electrically-driven heat pump, such as a Peltier device. TEHE 252 may include a distinct hot side 254 and cold side 256. A heat flux created between the junction of hot side 254 and cold side 256 may draw heat from the cold side 256 to the hot side 254 (e.g., as driven by an electrical current). Thus, when active, the cold side 256 of TEHE 252 may be maintained at a lower temperature than the hot side 254 of TEHE 252. In some embodiments, TEHE 252 is in operative communication with (e.g., electrically coupled to) controller 146, which may thus control the activation of or current to TEHE 252.

When assembled, active chiller 250 (e.g., at cold side 256) may be positioned along cold water line 230 between collection outlet 228 and cold water nozzle 234 (i.e., downstream from collection outlet 228 and upstream from cold water nozzle 234). Optionally, active chiller 250 may further be positioned downstream from reservoir 242 or water pump 244. Cold side 256, in particular, may be mounted on (e.g., against or within) cold water line 230 to direct heat therefrom and cool water within cold water line 230 (e.g., as it flows to cold water nozzle 234). By contrast, hot side 254 may be disposed outside of cold water line 230 (e.g., on fluid recirculation heat) such that heat from water within cold water line 230 is directed away from and outside of cold water line 230.

In still further additional or alternative embodiments, a heater 260 (e.g., heating element) is mounted along fluid recirculation duct 220 to selectively direct heat to air within air path 210. As shown, heater 260 is mounted along fluid recirculation duct 220 downstream from cold water nozzle 234 or collection outlet 228. Air returned to wash chamber 106 may thus be provided at an elevated temperature, advantageously increasing the drying efficacy and moisture capacity of the air within wash chamber. Optionally, heater 260 may be horizontally spaced apart from cold water nozzle 234 or collection outlet 228. Condensed water (e.g., within the liquid water stream 236) may thus separate from the dry air prior to the dry air reaching heater 260 along air path 210.

Generally, heater 260 may include any suitable heating element to be selectively activated (e.g., as directed by controller 146). For instance, heater 260 may include a resistive heating element, halogen heating element, radiant heating element, etc. In the illustrated embodiments of FIGS. 3 and 4, heater 260 includes the hot side 254 of TEHE 252. Specifically, the hot side 254 may be mounted on (e.g., against or within) fluid recirculation duct 220 outside of cold water line 230. During use, as heat is drawn from cold water line 230 by TEHE 252, at least a portion of that heat may advantageously be directed to fluid recirculation duct 220, thereby heating the dry air prior to it being returned to wash chamber 106.

It should be appreciated that, except as otherwise indicated, the present subject matter is not limited to any particular style, model, or configuration of dehumidification assembly 200. The exemplary embodiments depicted in FIGS. 2 through 4 are simply provided for illustrative purposes only. For example, different locations may be provided for dehumidification assembly 200, such as wherein fluid recirculation duct 220 or cold water line 230 are mounted on an outer portion of a wall defining wash chamber 106.

Figure 5:
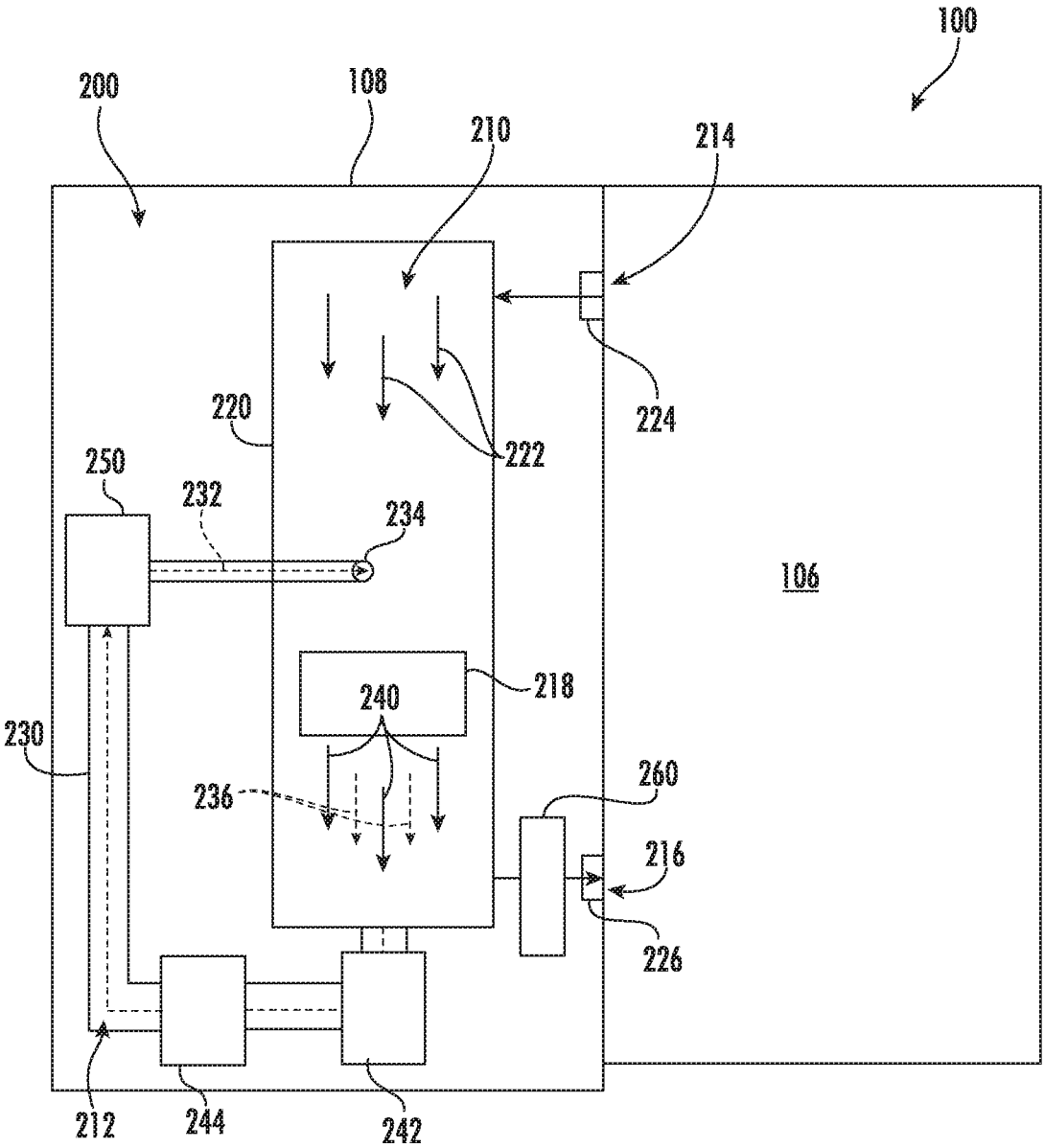
FIG. 5 provides a schematic view of a dishwashing appliance according to further exemplary embodiments of the present disclosure.

Turning especially to FIG. 5, a schematic view is provided of alternative embodiments of dishwashing appliance 100, including a dehumidification assembly 200. Except as otherwise indicated, it is understood that the exemplary embodiments of FIG. 5 include some or all of the features of the above embodiments. For instance, in some such embodiments, active chiller 250 and heater 260 are provided as discrete features, spaced apart or otherwise not in direct contact with each other.

In some such embodiments, active chiller 250 is mounted along cold water line 230 to selectively draw heat from water within water path 212. When assembled, active chiller 250 (e.g., at cold side 256) may be positioned along cold water line 230 between collection outlet 228 and cold water nozzle 234 (i.e., downstream from collection outlet 228 and upstream from cold water nozzle 234). Optionally, active chiller 250 may further be positioned downstream from reservoir 242 or water pump 244. Cold side 256, in particular, may be mounted on (e.g., against or within) cold water line 230 to direct heat therefrom and cool water within cold water line 230 (e.g., as it flows to cold water nozzle 234). By contrast, hot side 254 may be disposed outside of cold water line 230 (e.g., apart from fluid recirculation heat) such that heat from water within cold water line 230 is directed away from and outside of cold water line 230 (e.g., to the surrounding interior portion of door 108).

In additional or alternative embodiments, active chiller 250 includes at least a portion of a sealed refrigerant assembly provided with dehumidification assembly 200 for executing a vapor compression cycle. As would be understood, the sealed refrigerant assembly may include a compressor, a condenser, an expansion device, and at least one evaporator connected in fluid series and charged with a refrigerant. Moreover, within the sealed refrigerant assembly, gaseous refrigerant may flow into compressor, which operates to increase the pressure of the refrigerant. This compression of the refrigerant raises its temperature, which is lowered by passing the gaseous refrigerant through the condenser. Within the condenser, heat exchange (e.g., with ambient air) takes place so as to cool the refrigerant and cause the refrigerant to condense to a liquid state. The expansion device (e.g., a valve, capillary tube, or other restriction device) can receive liquid refrigerant from the condenser. From the expansion device, the liquid refrigerant may enter the evaporator. In particular the evaporator may be provided as, or as part of, active chiller 250 (e.g., in fluid isolation from the water within water path 212). Upon exiting the expansion device and entering the evaporator, the liquid refrigerant drops in pressure and vaporizes. Due to the pressure drop and phase change of the refrigerant, the evaporator is cool relative to cold water line 230 or water path 212.

Apart from active chiller 250, heater 260 may be mounted along fluid recirculation duct 220 to selectively direct heat to air within air path 210. As shown, heater 260 is mounted along fluid recirculation duct 220 downstream from cold water nozzle 234 or collection outlet 228. Optionally, heater 260 may be horizontally spaced apart from cold water nozzle 234 or collection outlet 228. Condensed water (e.g., within the liquid water stream 236) may thus separate from the dry air prior to the dry air reaching heater 260 along air path 210. Heater 260 may include any suitable heating element to be selectively activated (e.g., as directed by controller 146). For instance, heater 260 may include a resistive heating element, halogen heating element, radiant heating element, etc. mounted on (e.g., against or within) fluid recirculation duct 220.

Figure 6:
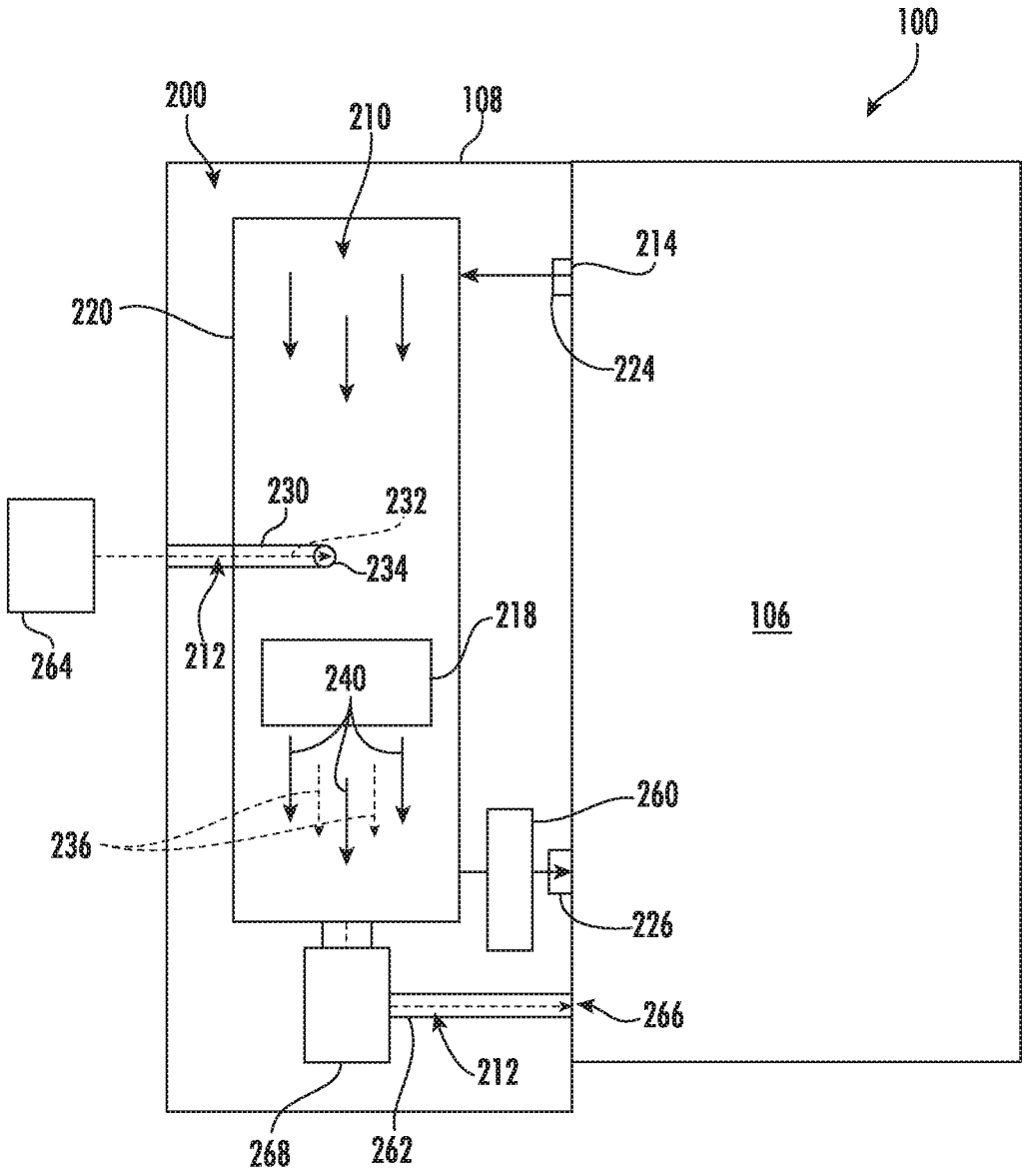
FIG. 6 provides a schematic view of a dishwashing appliance according to still further exemplary embodiments of the present disclosure.

Turning especially to FIG. 6, a schematic view is provided of alternative embodiments of dishwashing appliance 100, including a dehumidification assembly 200. Except as otherwise indicated, it is understood that the exemplary embodiments of FIG. 6 include some or all of the features of the above embodiments. For instance, in some such embodiments, water path 212 is defined by cold water line 230 and a separate drain line 262 mounted at distinct locations on fluid recirculation duct 220.

As shown, cold water line 230 may extend from a domestic water source (e.g., municipal water supply) and terminate at a portion of air path 210. For instance, cold water line 230 may extend from an area outside of fluid recirculation duct 220 to the interior of fluid recirculation duct 220, which defines air path 210. Thus, cold water line 230 may extend through fluid recirculation duct 220 (e.g., a wall thereof). Within fluid recirculation duct 220, a cold water nozzle 234 defined by cold water line 230 may be disposed. Thus, cold water nozzle 234 may be disposed in fluid communication between path inlet 214 and path outlet 216 to provide a condensing, cold-water flow 232 (e.g., at a relatively cold temperature from cold water source 264) into fluid recirculation duct 220 or air path 210.

During use, as the condensing, cold-water flow 232 sprays within air path 210, the water thereof may mix or entrain with the air from the wash chamber 106, including vaporized moisture in the air. As the condensing, cold-water flow 232 mixes with the air from wash chamber 106, the vaporized moisture within air path 210 may condense and separate upstream from collection outlet 228 or path outlet 216. In turn, a separate liquid water stream 236 (e.g., of the mixture of condensing, cold-water flow 232 and the condensed moisture from wash chamber 106) and a separated air stream 240 (e.g., of the remaining air from wash chamber 106) may be formed within fluid recirculation duct 220. In optional embodiments, cold water nozzle is positioned above collection outlet or path outlet 216. The liquid water stream 236 may thus flow downward (e.g., as motivated by gravity) before reaching collection outlet 228 or path outlet 216.

In some embodiments, drain line 262 may extend from collection outlet 228 to a downstream drain outlet 266. As shown, downstream drain outlet 266 may extend to wash chamber 106 (e.g., below path outlet 216). Thus, water may flow from the liquid water stream 236, through the collection outlet 228 and drain line 262 to wash chamber 106 (e.g., at sump 152—FIG. 2). During use, such water may be subsequently expelled from wash chamber (e.g., as part of a drain cycle).

In additional or alternative embodiments, a water valve 268 is mounted along drain line 262 to permit water (e.g., condensed water from liquid water stream 236) through drain line 262 or water path 212. In particular, water valve 268 may be mounted along drain line 262 between collection outlet 228 and drain outlet 266. Moreover, water valve 268 may be configured to selectively open (e.g., to permit water therethrough) and close (e.g., to prevent or restrict water from flowing therethrough), as is understood. When water valve 268 is open, water through drain line 262 may thus be permitted to the wash chamber 106 through water valve 268. By contrast, when water valve 268 is closed, water may be prevented from flowing through drain line 262 to wash chamber 106.

As would be understood, water valve 268 may be provided as any suitable valve (e.g., flapper valve, ball valve, solenoid valve, etc.) mounted along drain line 262 to selectively open and close. When assembled, water valve 268 may be in operative (e.g., electrical or wireless) communication with controller 146. Controller 146 may thus selectively direct water valve 268 to move between the opened and closed positions.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwashing appliance comprising:

a cabinet;

a tub housed within the cabinet and defining a wash chamber;

a pump configured to deliver a wash fluid to the wash chamber;

a spray assembly housed within the wash chamber of the tub in fluid communication with the pump to receive wash fluid therefrom;

a fluid recirculation duct extending from a path inlet to a path outlet to recirculate air within the wash chamber, the path inlet defined in fluid communication between the wash chamber and the path outlet, and the path outlet defined in fluid communication between the path inlet and the wash chamber downstream from the path inlet; and a cold water line extending through the fluid recirculation duct, the cold water line defining a cold water nozzle disposed within the fluid recirculation duct to provide a condensing, cold-water flow into the fluid recirculation duct between the path inlet and the path outlet.

2. The dishwashing appliance of claim 1, wherein the cold water line extends from a domestic water source.

3. The dishwashing appliance of claim 1, further comprising an active chiller mounted along the cold water line upstream from the cold water nozzle.

4. The dishwashing appliance of claim 3, wherein the active chiller comprises a thermoelectric heat exchanger having a cold side and a hot side, the cold side being mounted on the cold water line to direct heat therefrom, and the hot side being mounted on the fluid recirculation duct to direct heat thereto.

5. The dishwashing appliance of claim 1, further comprising a heater mounted along the fluid recirculation line downstream from the cold water nozzle.

6. The dishwashing appliance of claim 1, wherein the fluid recirculation line further defines a collection outlet upstream from the path outlet to permit condensed water to flow from the fluid recirculation duct, wherein the cold water line extends from the collection outlet to the cold water nozzle to return at least a portion of the condensed water to the fluid recirculation duct through the cold water nozzle.

7. The dishwashing appliance of claim 6, further comprising a water pump mounted along the cold water line to motivate the condensed water therethrough.

8. The dishwashing appliance of claim 1, wherein the fluid recirculation line further defines a collection outlet upstream from the path outlet to permit condensed water to flow from the fluid recirculation duct, and wherein the dishwashing appliance further comprises a drain line extending from the collection outlet to the wash chamber.

9. The dishwashing appliance of claim 1, further comprising a door rotatably attached to the cabinet to selectively restrict access to the wash chamber in a closed position, wherein the fluid recirculation duct is mounted within the door.

10. A dishwashing appliance comprising:

a cabinet;

a tub housed within the cabinet and defining a wash chamber;

a pump configured to deliver a wash fluid to the wash chamber;

a spray assembly housed within the wash chamber of the tub in fluid communication with the pump to receive wash fluid therefrom;

a fluid recirculation duct extending from a path inlet to a path outlet to recirculate air within the wash chamber, the path inlet defined in fluid communication between the wash chamber and the path outlet, and the path outlet defined in fluid communication between the path inlet and the wash chamber downstream from the path inlet, the fluid recirculation duct further defining a collection outlet upstream from the path outlet to permit condensed water to flow from the fluid recirculation duct; and a cold water line extending through the fluid recirculation duct, the cold water line defining a cold water nozzle disposed within the fluid recirculation duct upstream from the collection outlet to provide a condensing, cold-water flow into the fluid recirculation duct between the path inlet and the path outlet.

11. The dishwashing appliance of claim 10, wherein the cold water line extends from a domestic water source.

12. The dishwashing appliance of claim 10, further comprising an active chiller mounted along the cold water line upstream from the cold water nozzle.

13. The dishwashing appliance of claim 12, wherein the active chiller comprises a thermoelectric heat exchanger having a cold side and a hot side, the cold side being mounted on the cold water line to direct heat therefrom, and the hot side being mounted on the fluid recirculation duct to direct heat thereto.

14. The dishwashing appliance of claim 10, further comprising a heater mounted along the fluid recirculation line downstream from the cold water nozzle.

15. The dishwashing appliance of claim 10, wherein the cold water line extends from the collection outlet to the cold water nozzle to return at least a portion of the condensed water to the fluid recirculation duct through the cold water nozzle.

16. The dishwashing appliance of claim 15, further comprising a water pump mounted along the cold water line to motivate the condensed water therethrough.

17. The dishwashing appliance of claim 10, further comprising a drain line extending from the collection outlet to the wash chamber.

18. The dishwashing appliance of claim 10, further comprising a door rotatably attached to the cabinet to selectively restrict access to the wash chamber in a closed position, wherein the fluid recirculation duct is mounted within the door.

* * * * *